US006480085B2

(12) United States Patent
Chiang et al.

(10) Patent No.: US 6,480,085 B2
(45) Date of Patent: Nov. 12, 2002

(54) TRANSFORMER BOBBIN

(75) Inventors: Shen-Long Chiang, Taipei (TW); Chin-Chu Huang, Taipei (TW); Ching-Fu Hsueh, Taoyuan (TW); Cheng-Hsien Chien, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 09/876,215

(22) Filed: Jun. 7, 2001

(65) Prior Publication Data

US 2002/0017975 A1 Feb. 14, 2002

(30) Foreign Application Priority Data

Jun. 8, 2000 (TW) ..... 89111197

(51) Int. Cl.[7] ..... H01F 27/30
(52) U.S. Cl. ..... 336/198; 336/208; 336/192
(58) Field of Search ..... 336/192, 198, 336/208, 200, 182

(56) References Cited

U.S. PATENT DOCUMENTS 4,419,814 A * 12/1983 Hasserjian ..... 29/605
4,916,424 A * 4/1990 Kijima ..... 336/160
5,266,916 A * 11/1993 Kijima ..... 336/160

FOREIGN PATENT DOCUMENTS

EP 99/63554 * 9/1999

* cited by examiner

*Primary Examiner*—Anh Mai
(74) *Attorney, Agent, or Firm*—Rabin & Berdo, PC

(57) ABSTRACT

A bobbin of a transformer includes a hollow sleeve, a first pin set, a partition, and a second pin set. The hollow sleeve is a hollow polyhedron, and the hollow sleeve is wrapped around by a number of the copper coils. A winding-started point is near the corner of the hollow sleeve. The pin set includes a first pin and a first griding slot, wherein the first pin is for being wrapped around by a starting point of the first copper wire, and the first griding slot is for placing the copper wire segment from the starting point to the winding-started point. The partition is for connecting the hollow sleeve and the first pin set. The corner of the hollow sleeve is an intersection point of a top plane the hollow sleeve, a side plane of the hollow sleeve, and the partition. The transformer bobbin of the invention can prevent the short circuit and raise the yield of the transformer.

12 Claims, 9 Drawing Sheets

TRANSFORMER BOBBIN

This application incorporates by reference Taiwanese application Serial No. 89111197, Filed Jun. 8, 2000.

BACKGROUND OF THE INVENTION

1. Field of the Invention

The invention relates in general to a transformer bobbin, and more particularly to a transformer bobbin for preventing the coils from a short circuit.

2. Description of the Related Art

The transformer mainly includes a bobbin and a core for transforming the voltage between the low-voltage port and the high-voltage port of the bobbin. The low-voltage port and the high-voltage port of the bobbin are wrapped around by the copper coils, and the core is placed on the middle and the sides of the bobbin, which is able to complete the voltage transformation.

Referring to FIG. 1, which depicts a three-dimensional diagram of a bobbin on the conventional transformer. The bobbin 100 includes a hollow sleeve 102, the partitions 104, 106, 108, and 110, and the pin sets 112 and 114. The core is placed in the hollow part of the hollow sleeve 102 (not shown in FIG. 1), and the outside of the hollow sleeve 102 is wrapped around by the copper coils (not shown in FIG. 1). The partitions 104, 106, 108 and 110 are perpendicular connected to the hollow sleeve 102. The high-voltage port is formed by wrapping the copper coils around the hollow sleeve 102 between the partition 106 and 110. The low-voltage port is formed by wrapping the copper coils around the hollow sleeve 102 between the partition 106 and 104. The spools 120, 122 and 124 represent the space between the partitions 110 and 108, the space between the partitions 108 and 106, the space between the partitions 106 and 104, respectively. Moreover, the partitions 104 and 110 are perpendicular connected to the pin sets 112 and 114, respectively. The pin sets 112 and 114 include a number of pins that are twined round by the starting point and the terminal point of the copper coils.

Referring to FIG. 2A, which depicts a diagram that parts of the copper coils wrap around the bobbin in FIG. 1. Also, referring to FIG. 2B, which depicts a diagram that all of the copper coils wrap around the bobbin in FIG. 1. First, the pin 116 is twined round by the starting point 200 of the copper wire, as shown in FIG. 2A, and then, the hollow sleeve 102 between partitions 108 and 110 is clockwise wrapped around by the copper wire to construct the copper coil 204. In FIG. 2B, through a gap in the partition 108 (not shown in FIG. 2B), the copper wire continuously wraps around the hollow sleeve 102 between partitions 106 and 108. After completing the winding of the copper coil 204, the copper wire passes the side edge of the partition 108, and the terminal point 205 of the copper wire twines round the pin 118.

In order to give a clear description thereinafter, the copper wire segment from the starting point 200 to the winding-started point A is defined as the leading copper wire 206, and all of the copper coil 204 is defined as the coil body 208, wherein the winding-started point A is the point that the copper wire starts to wrap around the hollow sleeve 102.

Referring to FIG. 3A, which depicts a front view of the transformer in FIG. 2B along the X-axis. Also, referring to FIG. 3B, which depicts a lateral view of the transformer in FIG. 2B along the Y-axis. In FIG. 3A, the starting point 200 of the copper wire twins round the pin 116, and then multiple layers of the copper coil 204 wraps around the hollow sleeve 102. Portion of the leading copper wire 206 is lying on the pin set 114, and the other portion is placed on the surface of the partition 110 that is parallel to the YZ-plane. Therefore, the leading copper wire 206 placed on the partition 110 touches the coil body 208 at the interface 302.

In FIG. 3B, each circle represents a copper coil 204 outside of the hollow sleeve 102. Similarly, the starting point 200 of the copper wire twins round the pin 116, and part of the leading copper wire 206 touches the coil body 208 at the interface 302.

Accordingly, it could cause some problems that the leading copper wire 206 touches the coil body 208 at the interface 302. First, the high-voltage port includes spools 102 and 122, and the voltage difference between the starting point 200 and the terminal point of the copper wire is very big, and it can be in the range of 1000 to 1200 voltage. Moreover, the voltage difference between the leading copper wire 206 and the upper layer of the coil body 208, about 500 to 600 voltage, is also big. Therefore, the contact of the leading copper wire 206 and the coil body 208 is able to cause a short circuit if the insulating coating of the copper wire is defective. Second, the copper coil 204 wraps around the bobbin 100 by means of a rotating machine, and the rotational speed is pretty fast. Therefore, the copper coil 204 of the coil body 208 will rub against the leading copper wire 206 during the rotation, and the insulating effect disappears. If so, the transformer is broken and cannot work anymore.

SUMMARY OF THE INVENTION

It is therefore an object of the invention to provide a transformer bobbin, which the leading copper wire is isolated from the coil body. It can prevent the short circuit and raise the yield of the transformer.

The invention achieves the above-identified objects by providing a bobbin of a transformer for transforming voltage between a first port and a second port of the bobbin, the first port is wrapped around by a first copper wire and forming a plurality of copper coils of the first port, and the second port is wrapped around by a second copper wire and forming a plurality of copper coils the second port. The bobbin includes a hollow sleeve, a first pin set, a partition, and a second pin set. The hollow sleeve is a hollow polyhedron, wherein the hollow sleeve is wrapped around by the copper coils of the first port and copper coils of the second port. A winding-started point is near a corner of the hollow sleeve. The winding-started point is the point that the first copper wire starts to wrap around the hollow sleeve. The first pin set includes a first pin and a first griding slot, wherein the first pin is for being wrapped around by a starting point of the first copper wire, and the first griding slot is for placing the copper wire segment from the starting point to the winding-started point. The partition is for connecting the hollow sleeve and the first pin set. The second pin set includes a third pin and a fourth pin, wherein the third pin and the fourth pin are wrapped around by the starting point and the terminal point of the second copper wire, wire, respectively. The corner of the hollow sleeve is an intersection point of a top plane the hollow sleeve, a side plane of the hollow sleeve, and the partition.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1:
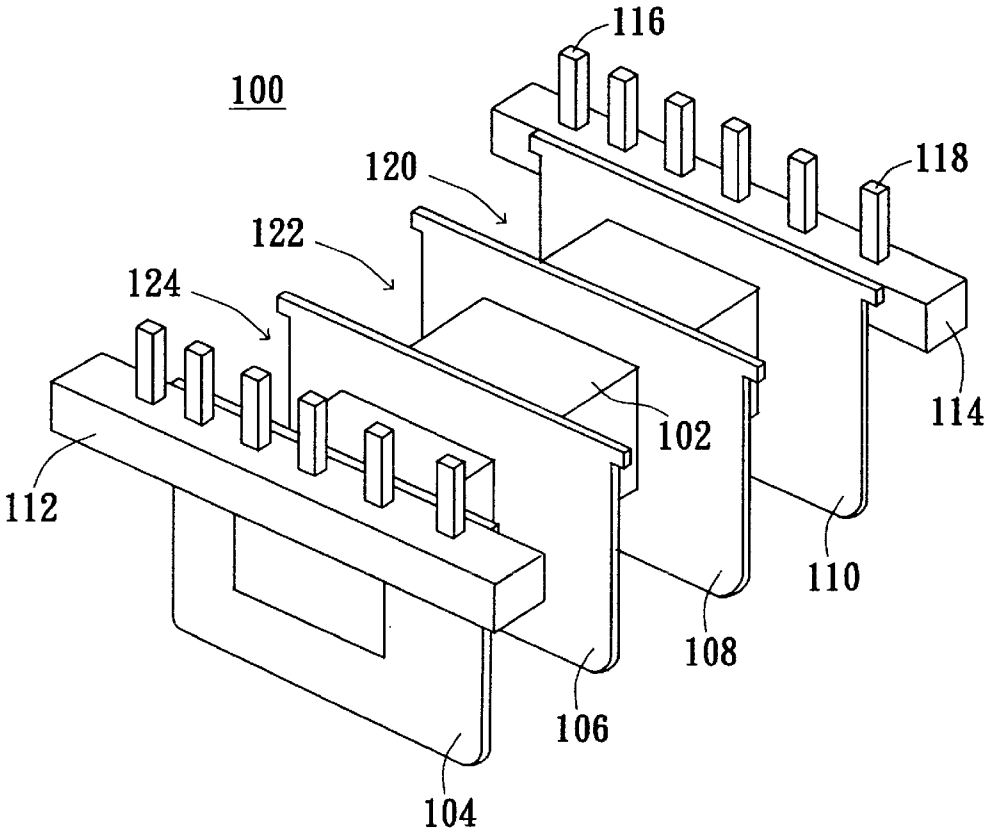
FIG. 1 (PRIOR ART)
FIG. 1 (Prior Art) depicts a three-dimensional diagram of a bobbin of the conventional transformer.
Figure 2A:
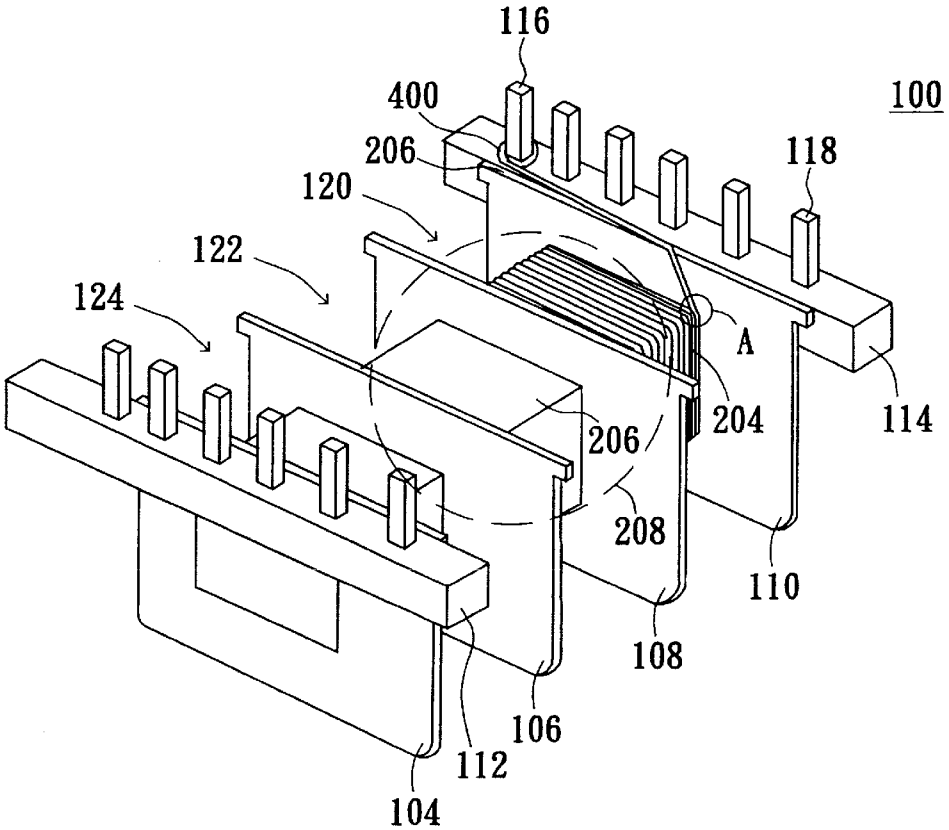
FIG. 2A (PRIOR ART)
FIG. 2A (Prior Art) depicts a diagram that parts of the copper coils wrap around the bobbin in FIG. 1.
Figure 2B:
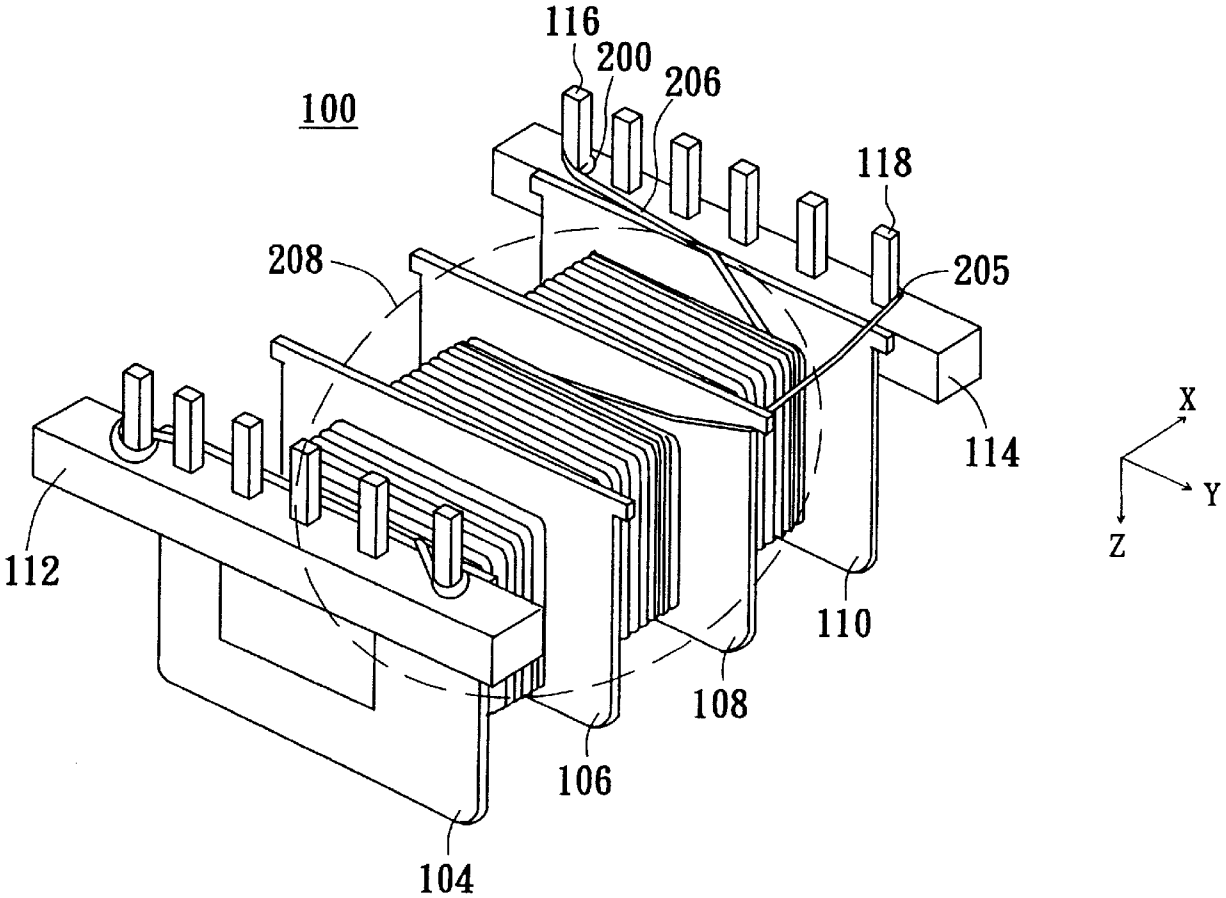
FIG. 2B (PRIOR ART)
Figure 3A:
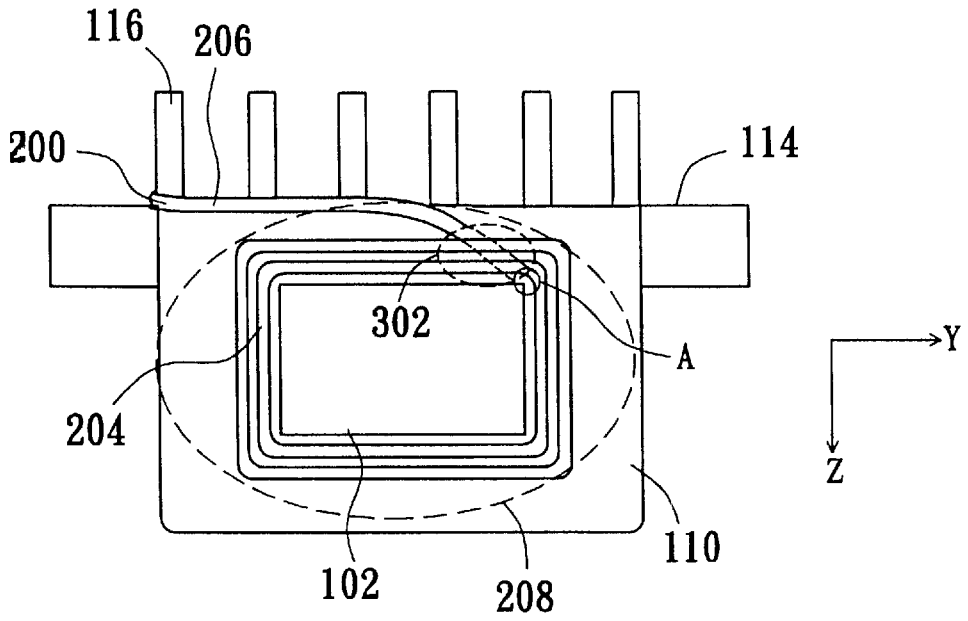
FIG. 3A (PRIOR ART)
FIG. 3A (Prior Art) depicts a front view of the transformer in FIG. 2B along the X-axis.
Figure 3B:
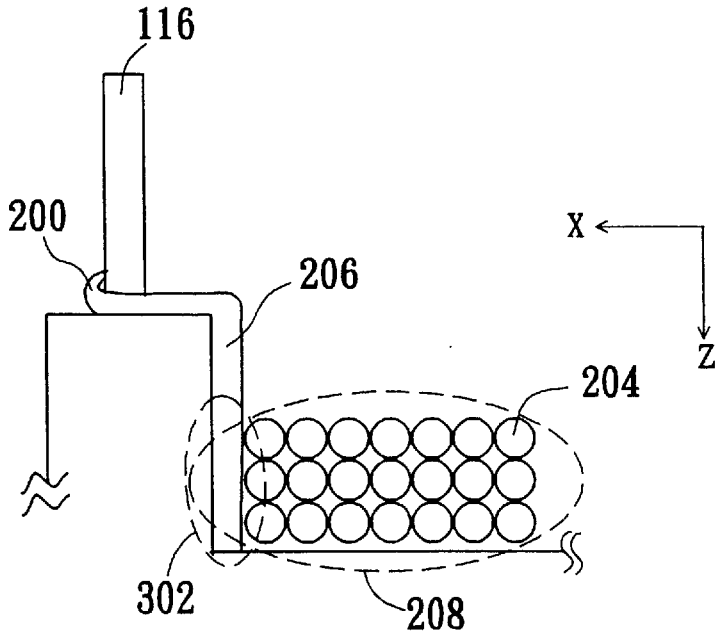
FIG. 3B (PRIOR ART)
FIG. 3B (Prior Art) depicts a lateral view of the transformer in FIG. 2B along the Y-axis.
Figure 4:
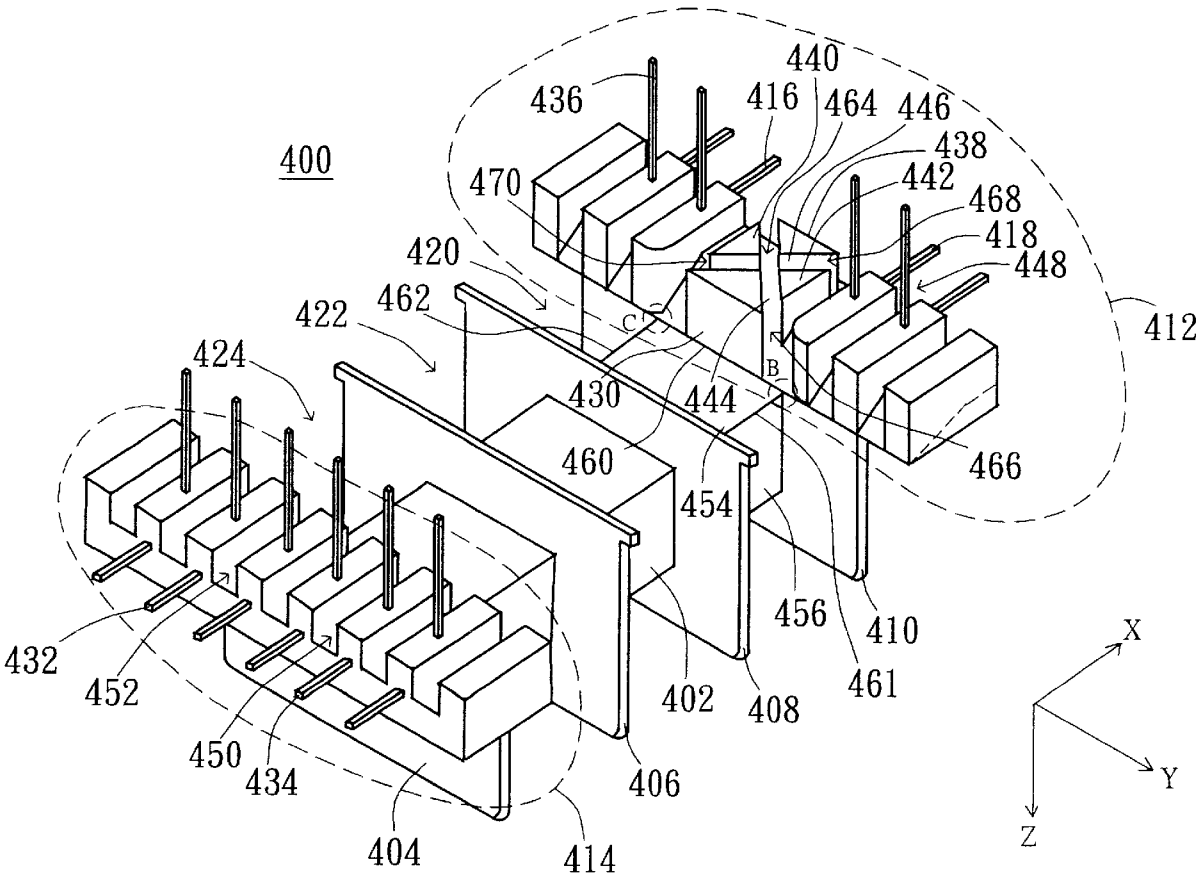
FIG. 4 depicts a diagram of a bobbin of the transformer according to the invention.

Referring to FIG. 4, which depicts a diagram of a bobbin of the transformer according to the invention. The bobbin 400 includes the hollow sleeve 402, the partition 404, 406, 408 and 410, the first pin set 412, and the second pin set 414. The first pin set includes a number of pins, such as the first pin 416 and second pin 418. The high-voltage port of the bobbin 400 is the section between the first pin set 412 and the partition 406, and the low-voltage port of the bobbin 400 is the section between the partition 406 and the second pin set 414.

The hollow sleeve 402 is a hollow cuboid. The hollow part is for placing a core (not shown in FIG. 4). The hollow sleeve 402 is wrapped around by the first copper wire and the second copper wire (not shown in FIG. 4), in order to form a number of copper coils of the high-voltage port and the low-voltage port, respectively.

The partition 404, 406, 408 and 410 are perpendicular connected to the hollow sleeve 102. The spools 420, 422 and 424 represent the space between the partitions 410 and 408, the space between the partitions 408 and 406, and the space between the partitions 406 and 404, respectively. The copper coils of the high-voltage port wrap around the spools 420 and 422, and the copper coils of the low-voltage port wrap around the spool 424. Besides, the partitions 410 and 404 are perpendicular connected to the first pin set 412 and the second pin set 414, respectively.

To improve the conventional transformer, a first griding slot is introduced into the first pin set 412. The first griding slot 444 and the hollow sleeve 402 intersect. The first pin 416 and the second pin 418 on the first pin set 412 are twined round by the starting point and the terminal point of the first copper wire, respectively. The first copper wire passes through the first griding slot 444, and then stops at the corner of the hollow sleeve 402, which is the winding-started point B, and starts to wrap around the hollow sleeve 402 for forming the copper coil of the high-voltage port. Because the winding-started point B is around the corner of the hollow sleeve, the problem of the short circuit due to the voltage difference in the conventional transformer can be solved.

Accordingly, the first griding slot 444 is designed for placing the segment of the first copper wire from the first pin 416 to the winding-started point B. Because the hollow sleeve 402 is a hollow rectangular solid, the winding-started point B is set close to the intersection point of the top plane 454, side plane 456 of the hollow sleeve 402, and the partition 410. The objective of the first griding slot 444 of the invention is to make the winding-started point B very close to the hollow sleeve 402. Hence, it is the spirit of the invention that the first copper coil start to wrap around the hollow sleeve 402 at the winding-started point B due to the construction of the first grinding slot 444.

Additionally, the first pin set 412 further includes a second griding slot in order to produce the inverse polarity of the transformer. The starting point of the first copper wire twins round the pin 418, and then the first copper wire passes through the second griding slot 446 to the second winding-started point C. Similarly, the second winding-started point C is set close to the intersection point of the top plane 454, side plane (not shown in FIG. 4) of the hollow sleeve 402, and the partition 410. With the first and second griding slots; a bobbin of the transformer is capable of producing two different polarities.

The aforementioned hollow sleeve 402 is a hollow cuboid; however, it could be a hollow polyhedron or cylinder. The griding slot in the bobbin of the transformer of the present invention can be set appropriately in accordance with the operating purpose, which is making the winding-started point very close to the hollow sleeve 402. For example, when the hollow sleeve 402 is a hollow polyhedron, the winding-started point should be the point around the corner of the hollow sleeve 402, such as the intersection point of the top plane, side plane of the hollow sleeve 402, and the partition 410.

In order to form the first griding slot 444 and the second griding slot 446, the first pin set 412 further includes a first isolating block 430, a second isolating block 438, a third isolating block 440, and a fourth isolating block 442. The first griding slot 444 and the second griding slot 446 intersect as X-wise, as shown in FIG. 4. The first isolating block 430 is set near the side of the hollow sleeve 402, and the second isolating block 438 is set far from the hollow sleeve 402. The third isolating block 440 and the fourth isolating block 442 set opposite at the first pin set 412, and both of them are set between the first isolating block 430 and the second isolating block 438. The top plane of a first isolating block 430, a second isolating block 438, a third isolating block 440, and a fourth isolating block 442 are isosceles triangle.

Moreover, the first pin set 412 further includes a number of grooves, such as groove 448. The spool 420 represents the space between the first isolating block 430, partition 410 and partition 408. Moreover, the second pin set 414 includes at least a third pin 432 and a fourth pin 434 for tying the starting point and the terminal point of the second copper wire, respectively. The second pin set 414 is also including a number of grooves, such as grooves 450 and 452.

The first pin set 412 and the second pin set 414 further include a number of vertical pins, such as pin 436. The bobbin 400 of the transformer is fixed to the printed circuit board (not shown in FIG. 4) by these vertical pins. In the conventional transformer, the pins are used not only for twining the copper wire round, but also for fixing the transformer to the printed circuit board; therefore, the coating of the copper wire which wraps around the pins could come off due to the reciprocal rubbing.

Therefore, the additional vertical pins of the present invention for fixing the transformer to the printed circuit board does effectively prevent the coating of copper wire on the pins from wearing down or rubbing away by means of friction that. So, the useful life of the transformer is extended.

Figure 5A:
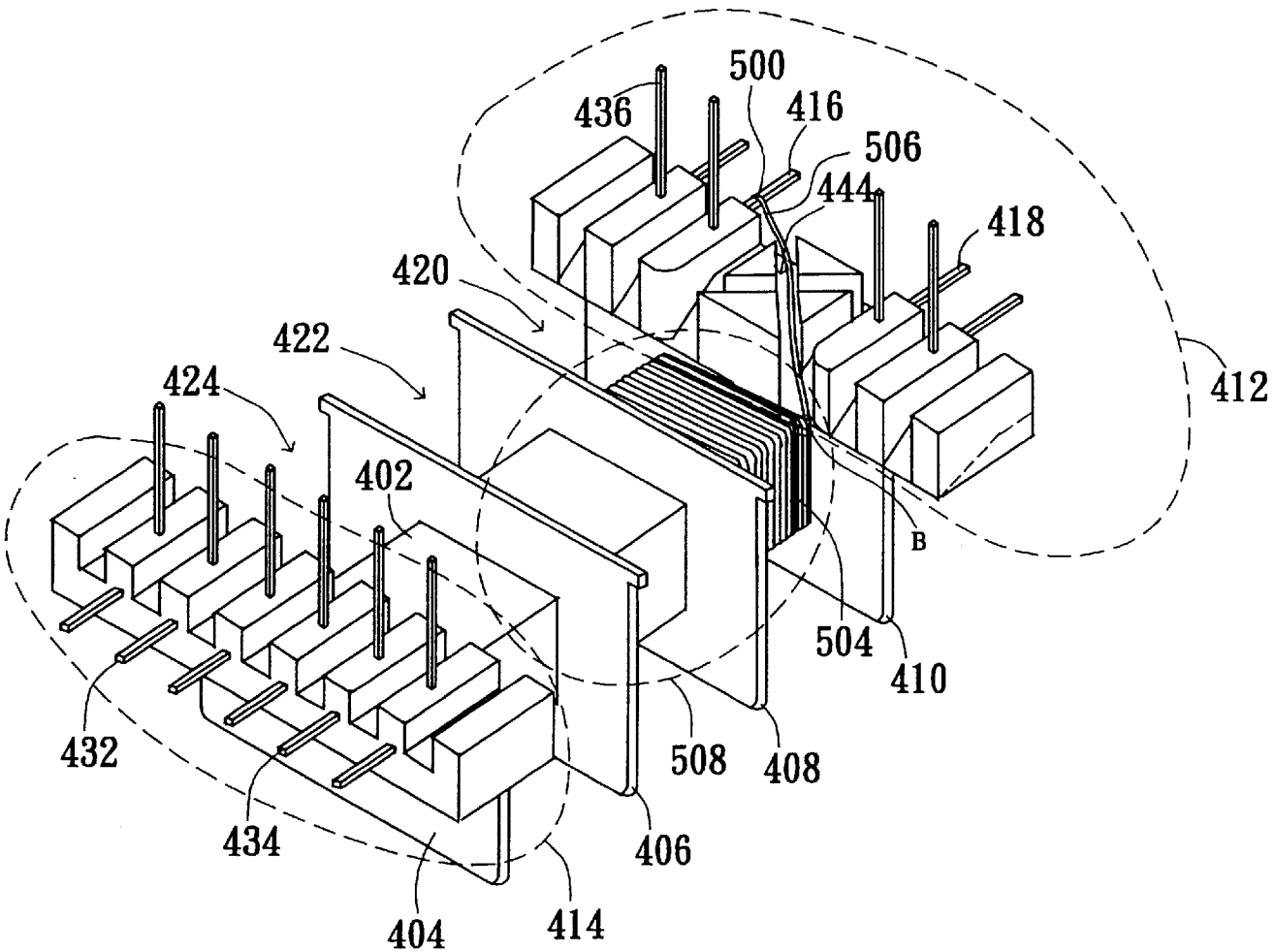
FIG. 5A depicts a diagram that parts of the copper coils wrap around the bobbin in FIG. 4.
Figure 5B:
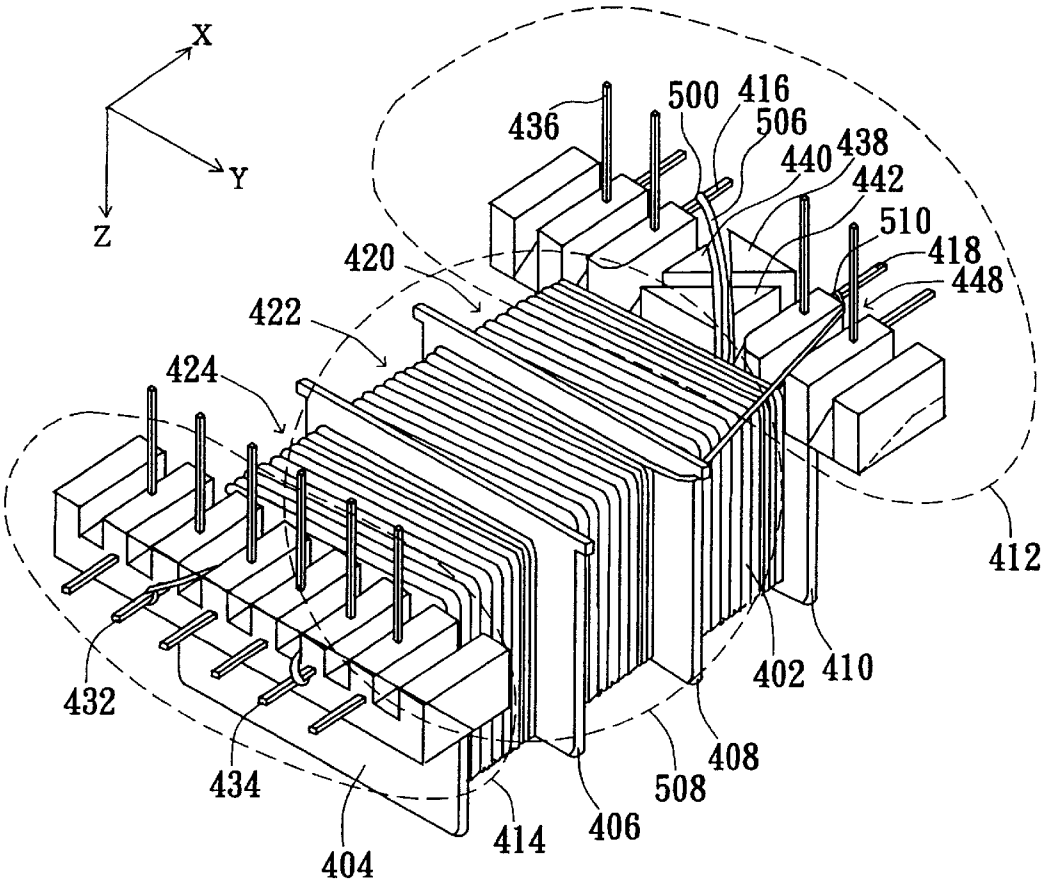
FIG. 5B depicts a diagram that all of the copper coils wrap around the bobbin in FIG. 4.

Referring to FIG. 5A, which depicts a diagram that parts of the copper coils wrap around the bobbin in FIG. 4. Referring to FIG. 5B, which depicts a diagram that all of the copper coils wrap around the bobbin in FIG. 4. In FIG. 5A, the spools 420 and 422 are wrapped around by the first copper wire to form the high-voltage port of the bobbin. The steps is described as follows. First, the starting point 500 of the first copper wire twins round the pin 416, and then, the first copper wire is placed into the griding slot 444, subsequently the first copper wire starts to wrap around the spool 420 clockwise at the winding-started point B.

In FIG. 5B, after all of the copper coil 504 wrapping around the spool 420, the first copper wire passes through a gap in the partition 408 (not shown in FIG. 5B) and continuously wraps around the spool 422. When the copper coil 504 of the high-voltage port is completely finished, the first copper wire passes the edge of the partition 408 and the groove 448, and then, the terminal point 510 twines round the pin 418.

In order to give a clear description thereinafter, the first copper wire segment from the starting point 500 to the winding-started point B is defined as the leading copper wire 506, and all of the copper coil 504 of high-voltage port is defined as the coil body 508. In the present invention, the first griding slot is connected to the winding-started point B so that the leading copper wire 506 is not going to contact with the coil body 508. Accordingly, the problem of conventional transformer, such as the short circuit due to high voltage difference or the coating of copper wire coming off, can be solved.

Figure 6A:
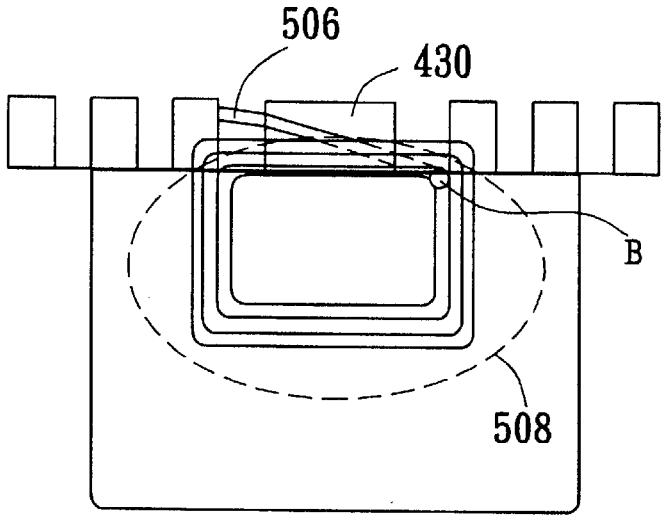
FIG. 6A depicts a front view of the transformer in FIG. 5B along the X-axis.
Figure 6B:
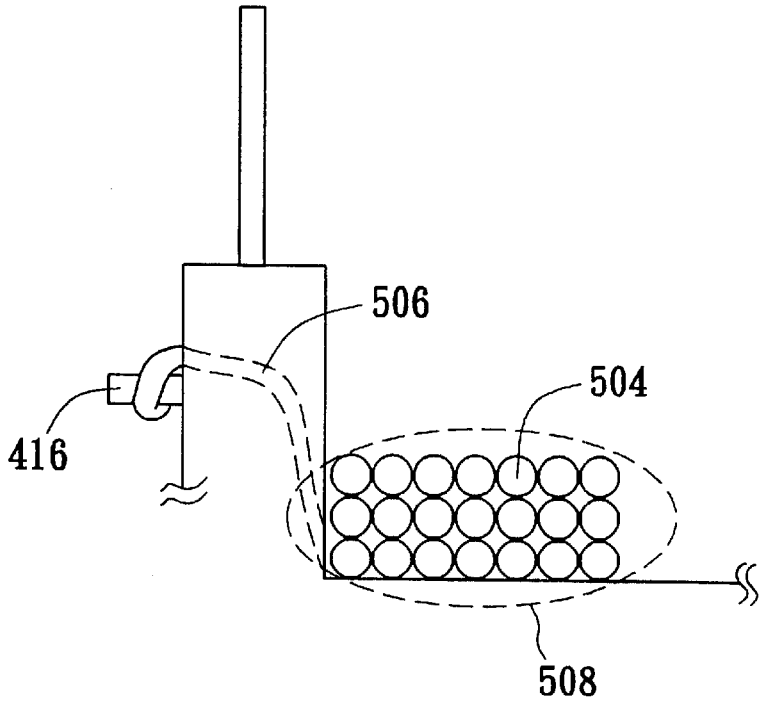
FIG. 6B depicts a lateral view of the transformer in FIG. 5B along the Y-axis.

Referring to FIG. 6A, which depicts a front view of the transformer in FIG. 5B along the X-axis. Also, referring to FIG. 6B, which depicts a lateral view of the transformer in FIG. 5B along the Y-axis. The leading copper coil 506 is placed in the first griding slot 444, and intersects the coil body 508 at the winding-started point B. Although the voltage difference between the leading copper coil 506 and the upper copper coil of the coil body 508 is big, the leading copper coil 506 and the coil body 508 are not in contact. Therefore, the short circuit condition due to the high voltage difference can be avoided.

Figure 7B:
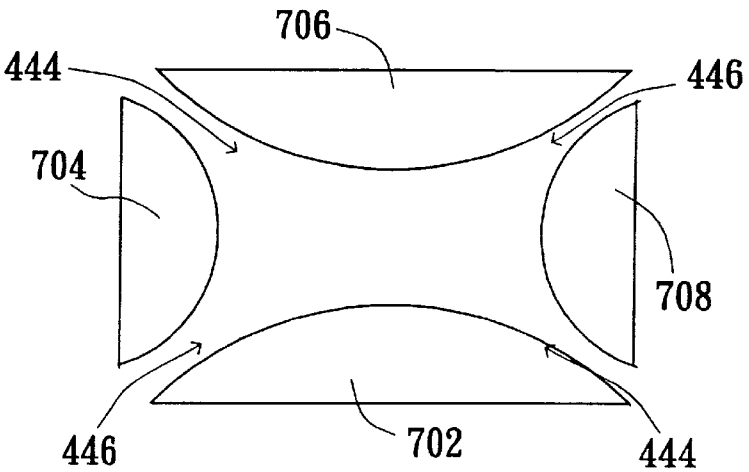
FIG. 7B depicts a top view of another form of the isolating blocks in FIG. 4.
Figure 7A:
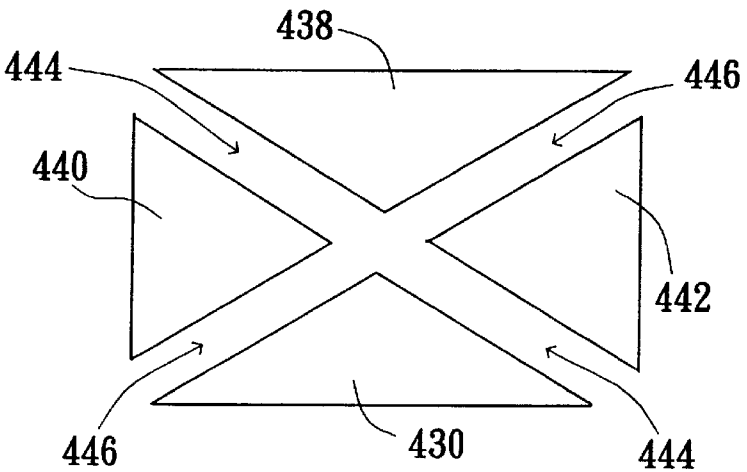
FIG. 7A depicts a top view of the isolating blocks in FIG. 4.

Referring to FIG. 7A, which depicts a top view of the isolating blocks in FIG. 4. Also, referring to FIG. 7B, which depicts a top view of another form of the isolating blocks in FIG. 4. In FIG. 7A, the top planes of the isolating blocks 430, 438, 440, and 442 are isosceles triangle. The first griding slot and the second griding slot are formed with these 4 isolating blocks. However, the shape of the isolating block is not limited in the invention. For example, the top plane of the isolating blocks 702, 704, 706, and 708 are not isosceles triangle. Each isolating block in FIG. 7B is constructed by a flat surface and cambered surface, so that a straight line and a curved line construct the perimeter of the top plane. It is the spirit of the invention that the isolating blocks form the first griding slot and the second griding slot to isolate the leading copper wire 506 and the coil body 508.

In other words, the bobbin 400 includes a hollow polyhedron sleeve 402 that has a top plane 454, and the top plane has a front side 460 (in FIG. 4), a rear side, a first side 461 and a second side 462. The first pin set 412 is installed on the front side 460 of the top plane 454, and the first pin 416 installed on the first pin set. The first griding slot 444 having a first end 464 and a second end 466 is installed on the first pin set 412, which the first end 464 is substantially near the first pin 416 and the second end 466 is substantially near the first side 461 of the top plane 454. The first pin set 412 further includes a second pin 436 and a second griding slot 446, which the second griding slot 446 has a third end 468 and a forth end 470, the third end 468 is substantially near the second pin 436 and the forth end 470 is substantially near the second side 462 of the top plane 454. Accordingly, the first griding slot 444 and the second griding slot 446 crosses at one point.

The transformer bobbin according to the invention has achieved the goal successfully that the leading copper wire is isolated from the coil body. It can prevent the short circuit and raise the yield of the transformer.

While the invention of the transformer bobbin has been described by way of example and in terms of the preferred embodiments, it is to be understand that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A bobbin of a transformer, comprising:

a hollow polyhedron sleeve having a first port and a second port, the first port comprising a first copper wire that is wrapped around the sleeve to form a plurality of copper coils of the first port, the second port comprising a second copper wire that is wrapped around the sleeve to form a plurality of copper coils of the second port, the hollow polyhedron sleeve having a first winding-started point at a first corner of the hollow polyhedron sleeve, and having a second winding-started point at a second corner of the hollow polyhedron sleeve, the first copper wire starting to wrap around the hollow polyhedron sleeve from one of the first winding-started point and the second winding-started point;

a first pin set installed on an end of the first port, and having:

a first pin and a second pint, each from being wrapped around by a starting point of the first copper wire;

a first griding slot for placing a copper wire segment from the first pin to the first winding-started point when the first copper wire is wrapped around the sleeve in a first direction;

a second griding slot for placing the copper wire segment from the second pin to the second winding-started point when the first copper wire is wrapped around the sleeve in a second direction that is converse to the first direction; and a first isolating block located on the first pin set and near the hollow polyhedron sleeve; and a second pin set installed on an end of the second port, and having a third pin and a fourth pin, the third pin and the fourth pin being wrapped around by a starting point and a terminal point of the second copper wire, respectively;

wherein the first corner of the hollow polyhedron sleeve is an intersection point of a top plane and a side plane of the hollow polyhedron sleeve, and the second corner of the hollow polyhedron sleeve is an intersection point of the top plane and another side plane of the polyhedron hollow sleeve.

2. The bobbin according to claim 1, wherein a second isolating block is located on the first pin set and far from the hollow polyhedron sleeve.

3. The bobbin according to claim 2, wherein a third isolating block and a fourth isolating block are set opposite at the first pin set, and the first isolating block, the second isolating block, the third isolating block and the fourth isolating block form the first griding slot and the second griding slot, and the first griding slot and the second griding slot intersect as X-wise.

4. The bobbin according to claim 3, wherein the top planes of the first isolating block, the second isolating block, the third isolating block, and the fourth isolating block are isosceles triangle.

5. The bobbin according to claim 4, wherein the perimeter of the top planes of the first isolating block, the second isolating block, the third isolating block, and the fourth isolating block are constructed by a straight line and a curved line.

6. The bobbin according to claim 1, wherein the first pin set and the second pin set further includes a plurality of vertical pins for fixing the transformer to a printed circuit board.

7. The bobbin according to claim 6, wherein the vertical pins are also for tying the starting point and a terminal point of the first copper wire.

8. The bobbin according to claim 1, wherein the bobbin further includes a partition vertically connected to the first pin set and the hollow polyhedron sleeve.

9. The bobbin according to claim 8, wherein the bobbin further includes a second partition vertically connected to the hollow polyhedron sleeve for separating the copper coils of the first port and the second port.

10. The bobbin according to claim 1, wherein the hollow polyhedron sleeve is hollow cuboid.

11. A bobbin of a transformer, comprising:

a hollow polyhedron sleeve having a top plane, the top plane having a front side, a rear side, a first side and a second side; and a first pin set installed on the front side of the top plane, comprising:

a first pin;

a second pin;

a first griding slot having a first end and a second end, the first end being substantially near the first pin and the second end being substantially near the first side of the top plane; and a second griding slot having a third end and a fourth end, the third end being substantially near the second pin and the fourth end being substantially near the second side of the top plane.

12. The bobbin according to claim 11, wherein the first griding slot and the second griding slot crosses at one point.

* * * * *